US006146186A

United States Patent [19]

Barrat et al.

[11] Patent Number: 6,146,186

[45] Date of Patent: Nov. 14, 2000

[54] INSULATION-DISPLACEMENT CONNECTOR

[75] Inventors: Sylvain Barrat, Belleville-sur-Saone; Bernard Bechaz, Caluire; Philippe France, Chazelles-sur-Lyon, all of France

[73] Assignee: Entrelec S.A., Villeurbanne, France

[21] Appl. No.: 09/281,000

[22] Filed: Mar. 30, 1999

[30] Foreign Application Priority Data

Apr. 17, 1998 [FR] France ..... 98 05053

[51] Int. Cl.[7] ..... H01R 4/24

[52] U.S. Cl. ..... 439/410; 439/784; 439/835

[58] Field of Search ..... 439/393, 397, 439/410, 417, 709, 816, 817, 818, 789, 409, 436, 835, 819–824

[56] References Cited

U.S. PATENT DOCUMENTS

| | | | |
|---|---|---|---|
| 4,466,682 | 8/1984 | Jusseau et al. | 439/391 |
| 4,752,237 | 6/1988 | Mixon, Jr. . | |
| 4,768,981 | 9/1988 | Hohorst | 439/828 |
| 5,588,881 | 12/1996 | Eggert et al. | 439/709 |
| 5,816,843 | 10/1998 | Gerberding | 439/410 |
| 5,816,867 | 10/1998 | Davidsz et al. | 439/828 |

FOREIGN PATENT DOCUMENTS

| | | |
|---|---|---|
| 0 247 360 A1 | 12/1987 | European Pat. Off. . |
| 2 503 464 | 10/1982 | France . |
| 2 023 170 | 12/1971 | Germany . |
| 38 15 548 A1 | 12/1989 | Germany . |

*Primary Examiner*—Paula Bradley
*Assistant Examiner*—Briggitte R. Hammond
*Attorney, Agent, or Firm*—Oliff & Berridge, PLC

[57] ABSTRACT

This connector comprises:

a conducting piece which has a slot intended to accommodate the cable to be connected and which is fitted into an insulating casing having an opening allowing insertion of a cable;

means allowing the cable to be stripped locally, these means being made on a piece separate from the conducting piece and facing the slot in the latter; and movement means for moving the cable from an insertion position to a connection position in which the cable is in the slot in the conducting piece, the cable passing through the means allowing it to be stripped locally during this movement.

10 Claims, 3 Drawing Sheets

INSULATION-DISPLACEMENT CONNECTOR

BACKGROUND OF THE INVENTION

The present invention relates to an insulation-displacement connector for an electrical cable consisting of a conducting core and an insulating sheath.

Such a connector allows an electrical cable to be connected to a conducting piece without it being necessary beforehand to strip one end of the electrical cable. The insulation-displacement connector strips the cable locally, for example by cutting into the insulating sheath surrounding the conducting core, before electrical contact is made between the conducting piece and the conducting core thus locally stripped.

DESCRIPTION OF THE PRIOR ART

European patent EP 0,247,360 discloses an insulation-displacement connector comprising a conducting connection piece which has a slot intended to accommodate the cable to be connected and which is fitted into an insulating casing which has at least one opening allowing insertion of the cable to be connected, as well as means allowing the electrical cable to be locally stripped. In this connector, the conducting piece has a slot for stripping and for retaining the core of the cable. This slot, which is straight, is made longitudinally along a profile-shaped part which is obtained, for example, from a flat blank, by stamping, resulting in it being cut, bent, and possibly thinned in places. The profiled part of the conducting piece has a hollow polygonal cross section which corresponds to a u whose free ends have been folded back toward each other obliquely and to the same extent. The profiled part thus obtained has two end folds corresponding to the abovementioned free ends that have been folded back obliquely and to the same extent. These two folds border the slot that they define. A stripping mouth of the conducting piece is made at one end of the slot. It is obtained by an oblique symmetrical cut in the folds bordering the slot at one of their ends. This oblique cut makes it possible to obtain a flared mouth. The subsequent bending of the folds, with respect to the walls which bear them, creates an upper edge sharp enough to pierce the sheath of the cables that are pushed into this mouth.

A special tool having an end-piece whose shape is suited to the shape of the conducting piece is provided for introducing an electrical cable into the conducting piece. The insulating casing into which the conducting piece is fitted is shaped so as to suit the tool.

This connector makes it possible to achieve, without prior stripping, good electrical contact between the conducting piece and the conducting core of a cable. The same conducting piece may accommodate cables of different diameters within a defined range of diameters.

One drawback of this connector is that it requires the use of a dedicated tool. Without this tool, it is very difficult to make a connection.

The conducting piece of this connector must be made from special materials in order to ensure both good stripping and good electrical contact and, as has emerged from the brief description above, this conducting piece is quite complicated to produce. As a result, the manufacturing cost of this connector is quite high.

SUMMARY OF THE INVENTION

The object of the present invention is therefore to provide a novel insulation-displacement connector. This connector can preferably be used without a dedicated tool and advantageously its manufacturing cost is not very high.

For this purpose, the insulation-displacement connector that the invention proposes, for an electrical cable consisting of a conducting core and an insulating sheath, comprises a conducting piece which has a slot intended to accommodate the cable to be connected, as well as means allowing the electrical cable to be stripped locally.

According to the invention, the means allowing the electrical cable to be stripped locally are produced on a piece which is separate from the conducting piece and face the slot in the latter, and movement means are provided for moving the cable from an insertion position in which the unstripped cable is inserted into the connector to a connection position in which the cable is in the slot in the conducting piece and in which the core of the cable is in electrical contact with the conducting piece, the cable passing through the means allowing it to be stripped locally during this movement.

In such a connector, the stripping and connection functions are provided by separate pieces. As a result, the pieces are quite simple to manufacture and can be made from "ordinary" materials.

This connector may, for example, be put into an insulating casing which includes an opening allowing insertion of the cable to be connected.

Various ways of acting on the movement means may be envisaged. Thus, a pusher such as, for example, the one described in patent FR-2,503,464 and which allows insertion of a cable into an insulation-displacement jaw, may be envisaged.

In a preferred embodiment, the conducting connection piece is fitted into an insulating casing having at least one opening allowing insertion of the cable to be connected and the movement means comprise a resilient blade provided with means for shifting the electrical cable, the means for shifting the cable facing the slot in the conducting piece when the resilient blade is in the rest position and facing the opening for insertion of the cable into the insulating casing when the resilient blade is in the prestressed position. In order to connect a cable, all that is then required is to prestress the resilient blade, insert a cable to be connected and release the resilient blade, which then tends to resume its rest position and which, with it, then shifts the cable toward the slot in the conducting piece.

In this embodiment, an opening is made in the insulating casing so as to allow passage of a tool, such as a screwdriver blade, for prestressing the resilient blade.

In order to correctly guide the cable to be connected, the shifting means preferably have a window through which this cable can pass. In certain configurations, it may be enough to have a fork, between the tines of which the cable is placed.

In order to limit the number of pieces in the connector and thus make their assembly easier, the movement means and the means allowing the cable to be stripped locally are advantageously made on the same piece.

In this case, the connector as claimed in the invention has, for example, a piece made from a resilient blade bent in such a way that its two ends are approximately parallel to each other, a first end being provided with two stripping lips and the other end being provided with means for shifting the cable such as, for example, a window.

The resilient blade, on the side facing the stripping lips, then preferably rests on the conducting piece, the shape of which it matches, the stripping lips being inclined with respect to the resilient blade in such a way that the stripping part of these lips is properly positioned facing the slot in the conducting piece. In this way, the correct relative positioning of the stripping lips with respect to the conducting piece is achieved. This is important so that the part stripped by the lips is properly positioned at the edge of the slot produced in the conducting piece, thereby guaranteeing a good contact between the stripped part and the conducting piece.

In order to improve the guidance of the cable during the stripping, the means for shifting the cable preferably comprise guiding lugs having approximately the shape of the stripping lips.

In order to make a good electrical connection, the slot intended to accommodate the cable to be connected advantageously has a V-shaped opening and is extended, on the side facing the tip of the V, by two approximately parallel edges.

The present invention also relates to a connection block comprising an insulating casing and a conducting piece intended to be electrically connected to at least one electrical cable, which connection block is provided with at least one insulation-displacement connector as described above.

BRIEF DESCRIPTION OF THE DRAWING

In any case, the invention will be clearly understood with the aid of the description which follows, with reference to the appended diagrammatic drawing, showing by way of nonlimiting example a preferred embodiment of a connector as claimed in the invention:

DESCRIPTION OF THE PREFERRED EMBODIMENTS

Figure 1:
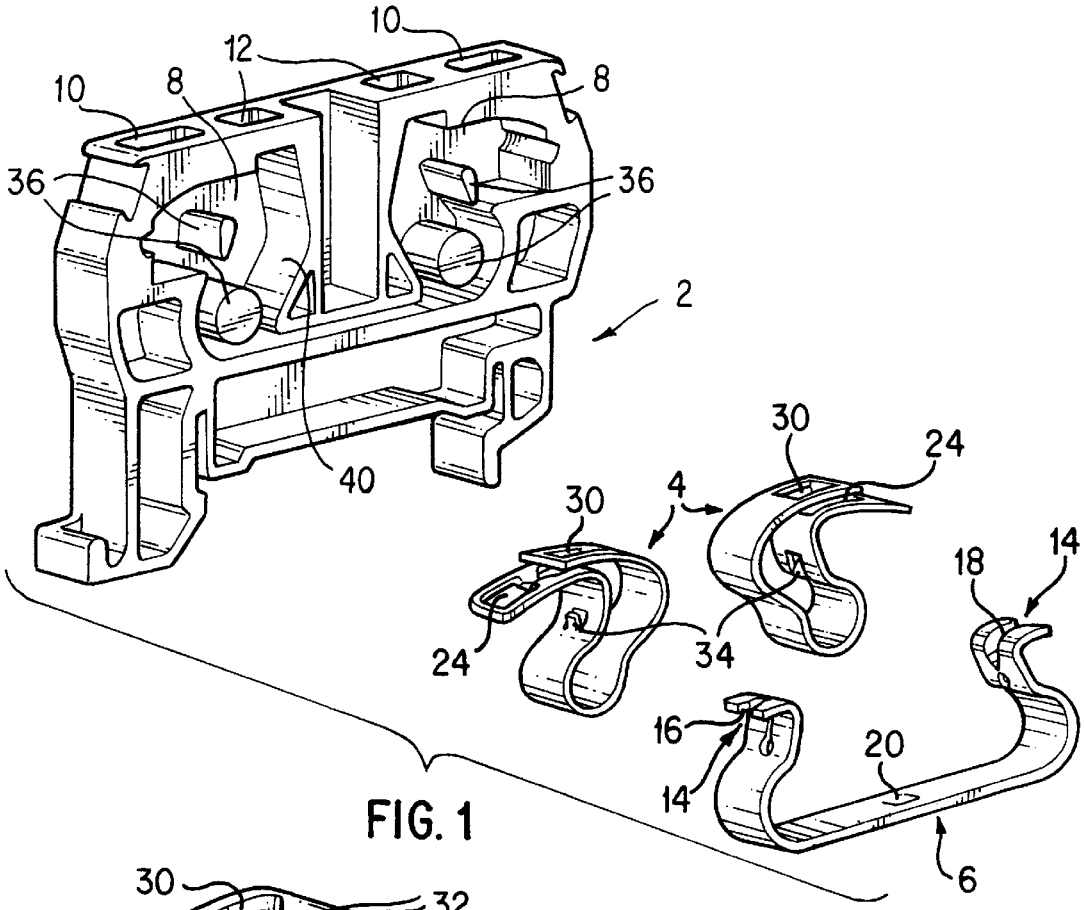
FIG. 1 is an exploded perspective view of a connection block comprising two connectors as claimed in the invention.

FIG. 1 shows a connection block equipped with two connectors. This connection block comprises an insulating casing 2, two springs 4 and a conducting piece 6.

The insulating casing 2 is a piece made of a synthetic material obtained, for example, by molding. The shape of its base is such that it can be fixed to standardized fixing rails provided for this purpose. A housing 8 is provided for each spring 4 and each end of the conducting piece 6. The upper face of the casing 2 has, in each housing, both an opening 10 intended to accommodate a cable to be connected and an opening 12 intended to accommodate the blade of a screwdriver.

Figure 3:
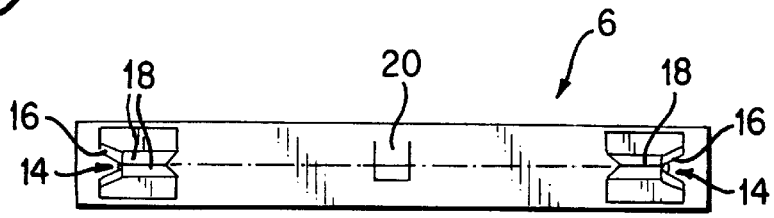
FIG. 3 is a top view of a conducting piece.

The conducting piece 6 is shown in perspective in FIG. 1 and seen from above in FIG. 3. This piece 6 may accommodate two electrical cables, one at each of its ends. This conducting piece 6 is made from a metal blade, for example a blade made of copper.

At each end of the blade there is a slot 14, the shape of which can be seen in FIG. 3. Each slot 14 is made along the longitudinal mid-axis of the blade. At the end of the blade, the slot 14 has a V-shaped region 16, the tip of the V being on the inside of the blade. The slot 14 is extended by a region 19 in which the edges of the slot arm approximately parallel. Thus, each end of the conducting piece is in the form of a fork, each arm of which has a degree of elasticity, by virtue of which the slot 14 can accommodate cables of various diameters while still guaranteeing an excellent electrical contact.

The edges of the slot 14 are thinned both in the V-shaped region 16 and in the region 18 where the edges are parallel. This thinning does not provide the slot with a cutting function but it is done to match the dimensions of the cut which In made at the springs 4 and which will be described below.

The blade forming the conducting piece 6, once each of its end has been provided with a slot 14, is then bent so that each of its ends has a shape reminiscent of a swan's neck, as may be seen, for example, in FIG. 1.

A tab 20 is produced approximately in the middle of the conducting piece so as to allow it to be snap-fastened into the insulating casing 2.

Figure 2:
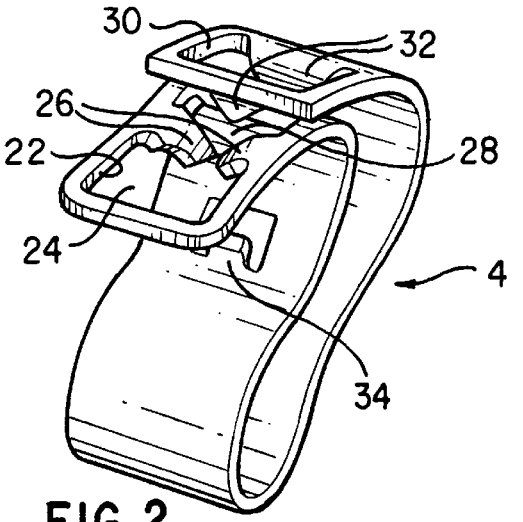
FIG. 2 is a perspective view, on an enlarged scale, of a spring used for a connector as claimed in the invention.

FIG. 2 shows a spring 4 in greater detail. Such a spring is formed from a resilient blade which also may, for example, be made of copper. This resilient blade is bent so as to form a spring. The width of the resilient blade used is approximately equal to the width of the blade used for producing the conducting piece 6. After bending, the two ends of the resilient blade are approximately parallel to each other. The central region of the resilient blade is bent so as to form a circular arc of slightly more than 180°. Thus, the approximately parallel ends of the spring may move elastically one with respect to the other. In the rest position, shown in FIG. 1 for example, the two ends of the resilient blade are offset one with respect to the other.

A first end of the resilient blade is bent so as to be able to match the swan-neck shape of one end of the conducting piece 6. As may be seen in FIGS. 4 to 6, each spring 4 is placed in its housing 8 on one end of the conducting piece 6. The rounded central part of the spring 4 is placed at the base of the swan-neck shape of one end of the conducting piece 6. The spring 4 follows the shaped upper face of the entire swan-neck end of the conducting piece 6 and one end of this spring extends beyond the conducting piece 6. The other end of the spring 4 is placed above this first end.

Figure 4:
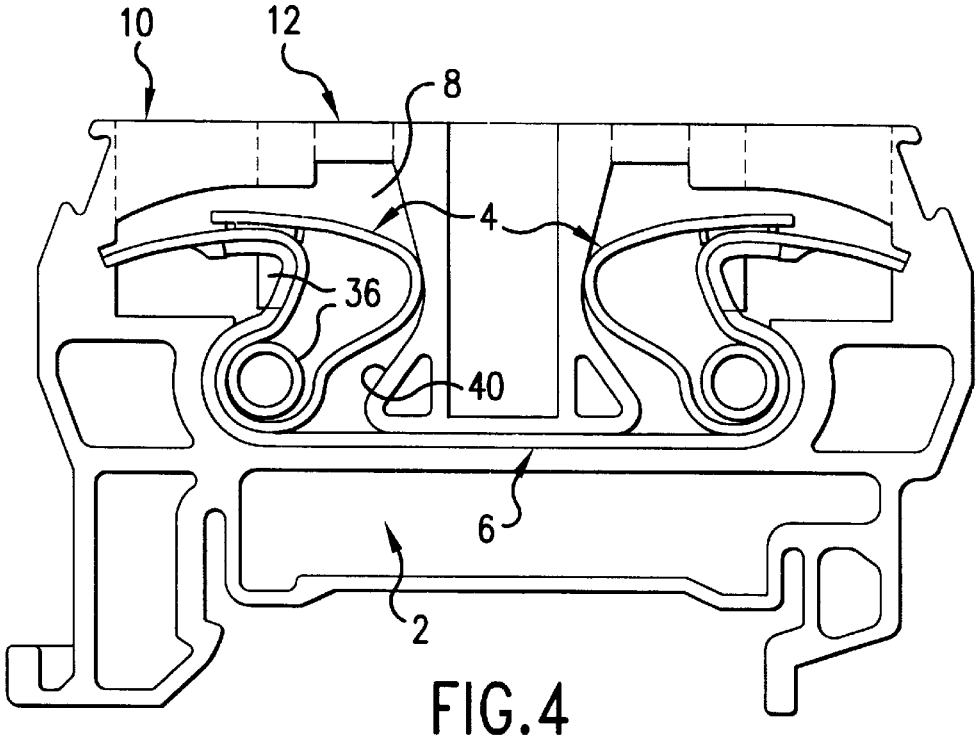
FIGS. 4 to 6 are front views of the connection block in FIG. 1 during three steps of connecting a cable.
Figure 5:
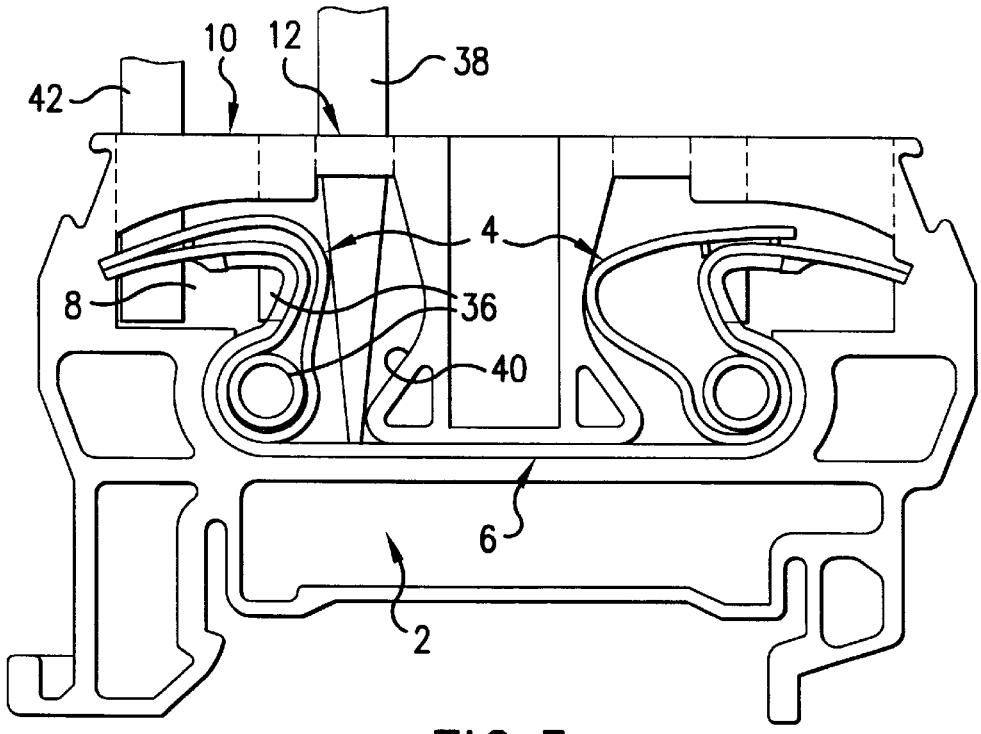
Figure 6:
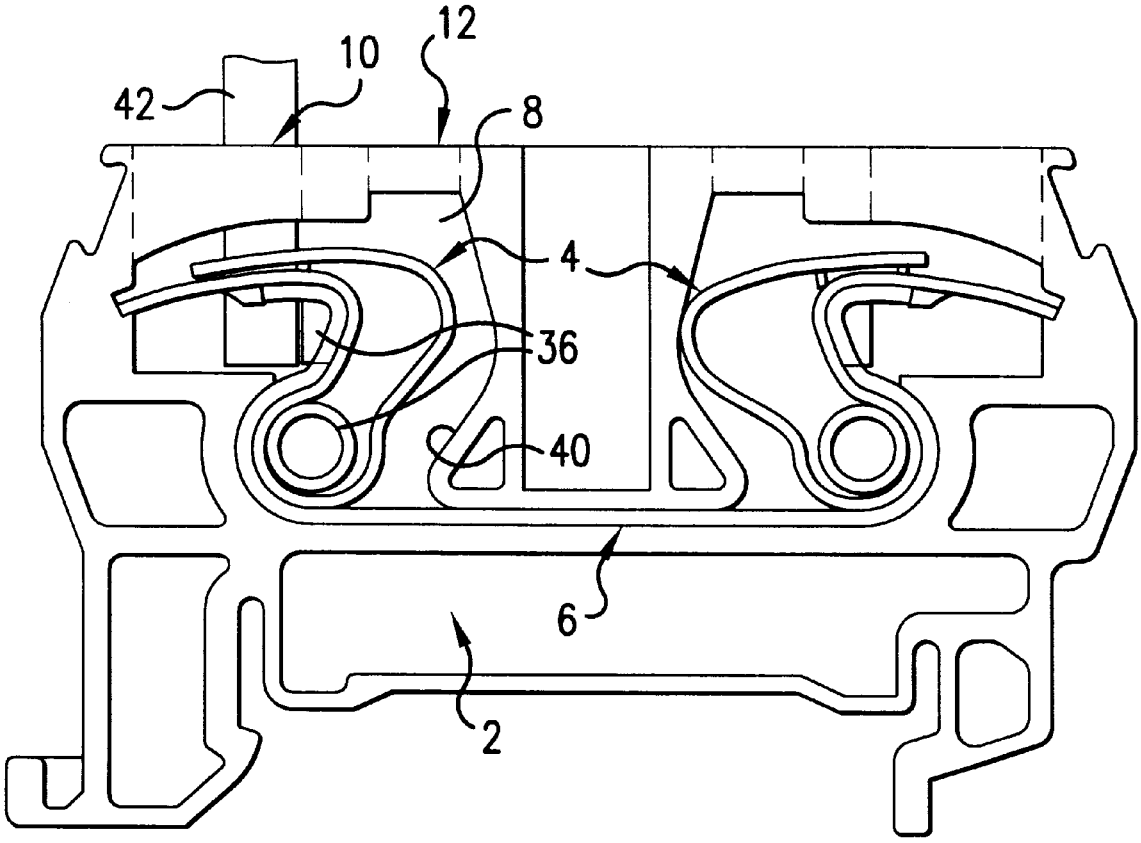

The end of the spring 4 which rests on the conducting piece 6 is provided with a window 22. This window 22 has, on the same side as the end of the spring 4, a space 24 of sufficient size to accommodate an electrical cable to be connected. Inside the window 22 there are also two stripping lips 26. These lips 26 extend in a transverse direction with respect to the resilient blade forming the spring 4 and are inclined away from the other end of the spring. Thus, these lips project from the resilient blade on the same side as the conducting piece 6 when the spring 4 is fitted onto this conducting piece 6 (FIGS. 4 to 6). The ends of the lips 26 are spaced apart so as to cut the insulating sheath of an electrical cable which is moved longitudinally with respect to the resilient blade forming the spring 4 without damaging the conducting core of this cable. The window 22 also has a space 28 intended to accommodate a cable once the latter has been stripped locally by the stripping lips 26.

The spring 4 is placed on the conducting piece 6 in such a way that the stripping lips 26 butt against the end of the conducting piece 6. The lips 26 are then facing the slot 14. Care is taken to ensure that the stripping region of the lips 26 lies level with the thinned edges of the slot 14.

The other end of the spring 4 is also provided with a window 30. The latter is intended to accommodate an electrical cable to be connected and to guide the latter in order to make it pass through the space 24 in the first window 22 across the stripping lips 26 in order to bring it into the space 28 intended for accommodating a connected cable. The window 30 has an approximately square shape having two longitudinal edges and two edges that are transverse to the resilient blade forming the spring 4. The two transverse edges are each provided with a lug 32. Each lug 32 extends toward the other end of the spring 4. These lugs have approximately the shape of the stripping lips 26. Thus, the lugs are V-shaped, each branch of the V being inclined approximately in the same way as the lips 26 are inclined. In this way, the lugs 32 allow correct guiding of a cable to be connected in order for this cable to be passed between the stripping lips 26. The cable to be stripped and to be connected is therefore guided over the entire length of the lug and not simply over the thickness of the resilient blade 4.

When the spring 4 is in the rest position, the window 30 lies approximately above the space 28 in the window 22. In the prestressed position, the window 30 lies above the space 24 in the window 22. A tab 34 is provided on each spring 4 so as to hold the latter properly in place on the conducting piece 6. The tab 34 may, for example, engage with the end of a slot 14 opposite the end with a V-shaped region 16.

FIG. 4 shows a conducting piece 6 and two springs 4 at rest in the insulating casing 2. The springs 4 and the swan-neck ends of the conducting piece 6 are each placed in a housing 8. In order to position these pieces properly, stops 36 are provided inside the housings 8. Thus, there is a stop 36 placed inside the rounded part of the spring 4 and another stop 36 allowing one end of the conducting piece 6 to be properly positioned.

The operation of a connector as claimed in the invention is described below with reference to FIGS. 4 to 6.

FIG. 4 shows the two connectors in the rest position. Each space 24 intended to accommodate a cable to be connected faces an opening 10 in the casing. The windows 30 for moving a cable are moved aside with respect to these openings 10. A first operation to be carried out, in order to connect a cable, is to prestress the spring 4. This is achieved by inserting the end of a tool, for example a screwdriver blade, through an opening 12 in the casing 2. The blade 38 of the screwdriver encounters the spring 4 and is deflected toward a wall 40 of the housing 8. The shape of this wall 40 is such that, by pushing the screwdriver right into the opening 12 until the blade 38 of the screwdriver reaches the bottom of the housing 8, or more precisely comes into abutment with the conducting piece 6, the spring is deformed in such a way that the window 30 in the spring comes face to face with the space 24 of the window 22 in the spring intended to accommodate a cable 42 to be connected.

FIG. 5 shows the spring 4 in its position in which it is prestressed by the action of the screwdriver blade 38 and also shows the end of a cable 42 which has been inserted via an opening 10 into the casing 2. This end of the cable 42 encounters no obstacle and firstly passes through the window 30 in the spring and then the space 24 of the window 22 in this spring. The cable 42 consists of a conducting core and an insulating sheath.

Since the end of the cable 42 has now been inserted into the casing 2, the screwdriver blade 38 can be withdrawn from this casing 2. The spring 4 is therefore released. The energy stored, in this spring while it was being deformed by the screwdriver blade is recovered and serves to pass the end of the cable 42 through the stripping lips 26 and to make the connection to the conducting piece 6. The end of the cable 42 is guided over the entire length of a lug 32 when it passes between the lips 26. During passage between these lips, the insulating sheath of the cable is cut transversely to the axis of the cable 42, thus locally baring the conducting core of the cable. The shape of the lips 26 gives them an elasticity which allows them to adapt to cable diameters lying within a predetermined range of diameters- For each cable diameter in this range, the lips 26 cut the insulating sheath so as to bare the conducting core locally without, however, damaging the latter.

Once the end of the cable has been stripped, it is forced into the slot 14 in the conducting piece 6. The stripped region of the end of the cable 42 then slides level with the thinned edges of the slot 14. The end of the cable 42 is housed at the base of the V-shaped region 16. The spring is therefore not in its rest position. An elastic stress is therefore still exerted on the cable 42, especially by means of the lug 32. This stress is conducive to good electrical contact between the conducting core of the cable 42 and the conducting piece 6.

As goes without saying, the intention is not limited to the embodiment described above by way of nonlimiting example; on the contrary, it encompasses all variants thereof.

Thus, for example in the above embodiment, the means allowing the end of the cable to be connected to be moved and the means allowing the latter to be stripped locally are produced on the same piece, namely the spring. As is apparent from the above description, it will be noted that part of this spring is fixed and does not move throughout the connection operation. It is therefore completely conceivable to have a fixed piece at which the stripping of the end of the cable would be carried out and a movable piece which allows the end of the cable to be moved.

The shapes of the various constituent components of the connector described are given by way of example and are not limiting. They are preferred embodiments. Thus, other shapes may be chosen for the spring, for the stripping lips, for the movement window, the conducting piece, the slot in the latter, etc.

Of course, it is conceivable for the connector to be applied to an electrical device other than a connection block. Such a connector may be used for connecting a cable to various types of electrical appliances. This connector may also be used without there being an insulating casing.

What is claimed is:

1. An insulation-displacement connector for an electrical cable consisting of a conducting core and an insulating sheath, which comprises:

a conducting connection piece which has a slot intended to accommodate the cable to be connected;

means for stripping the electrical cable locally, wherein the means for stripping the electrical cable locally are produced on a piece which is separate from the conducting piece and face the slot in the conducting piece; and movement means for moving the cable from an insertion position in which the unstripped electrical cable is inserted into the connector to a connection position in which the cable is in the slot in the conducting piece and in which the core of the cable is in electrical contact with the conducting piece, the cable passing through the means for stripping the electrical cable locally during this movement.

2. The connector as claimed in claim 1, wherein the slot intended to accommodate the cable to be connected has a V-shaped opening and is extended, on the side facing a tip of the V, by two parallel edges.

3. The connection block comprising an insulating casing and a conducting piece intended to be electrically connected to at least one electrical cable, which is provided with at least one insulation-displacement connector as claimed in claim 1 to 2.

4. The connector as claimed in claim 1, wherein the conducting connection piece is fitted into an insulating casing having at least one opening allowing insertion of the cable to be connected and the movement means comprise a resilient blade provided with means for shifting the electrical cable, the means for shifting the cable facing the slot in the conducting piece when the resilient blade is in the rest position and facing the opening for insertion of the cable into the insulating casing when the resilient blade is in a pre-stressed position.

5. The connector as claimed in claim 4, wherein an opening is provided in the insulating casing so as to allow passage of a tool in order to prestress the resilient blade.

6. The connector as claimed in claim 4, wherein the shifting means have a window through which the cable to be connected can pass.

7. The connector as claimed in claim 1, wherein the movement means and the means for stripping the electrical cable locally are produced on a same piece.

8. The connector as claimed in claim 7, wherein the means for stripping the electrical cable locally is made from a resilient blade bent in such a way that its two ends are parallel to each other, a first end being provided with two stripping lips and the other end being provided with means for shifting the cable.

9. The connector as claimed in claim 8, wherein the resilient blade, on the side facing the stripping lips, rests on the conducting piece, the stripping lips being inclined with respect to the resilient blade in such a way that the stripping part of these lips is properly positioned facing the slot in the conducting piece.

10. The connector as claimed in claim 8, wherein the means for shifting the cable comprise guiding lugs having the shape of the stripping lips.

* * * * *